US006820374B2

(12) United States Patent
Schwörer

(10) Patent No.: US 6,820,374 B2
(45) Date of Patent: Nov. 23, 2004

(54) STAGE CONSTRUCTION

(75) Inventor: Arthur Schwörer, Senden (DE)

(73) Assignee: Peri GmbH (DE)

( * ) Notice: Subject to any disclaimer, the term of this patent is extended or adjusted under 35 U.S.C. 154(b) by 69 days.

(21) Appl. No.: 10/276,810

(22) PCT Filed: May 25, 2001

(86) PCT No.: PCT/DE01/02007

§ 371 (c)(1),
(2), (4) Date: Nov. 15, 2002

(87) PCT Pub. No.: WO01/90513

PCT Pub. Date: Nov. 29, 2001

(65) Prior Publication Data

US 2003/0121215 A1 Jul. 3, 2003

(51) Int. Cl.[7] ..... E04H 3/26
(52) U.S. Cl. ..... 52/7; 52/8; 52/9
(58) Field of Search ..... 52/8, 9

(56) References Cited

U.S. PATENT DOCUMENTS 2,171,374 A 8/1939 Ryan et al.
2,854,704 A 10/1958 Gilbert
3,869,835 A * 3/1975 Mackintosh ..... 52/9
4,207,713 A * 6/1980 Chatenay ..... 52/9
4,879,848 A 11/1989 Gardner et al.
6,003,270 A 12/1999 MacIntyre
6,474,024 B1 * 11/2002 Macintyre ..... 52/9
6,539,672 B1 * 4/2003 Frost ..... 52/9

* cited by examiner

*Primary Examiner*—Steve M Varner
(74) *Attorney, Agent, or Firm*—Walter A. Hackler

(57) ABSTRACT

The invention relates to a stage, comprising elements, which may be assembled and disassembled from individual pieces, as part of a sub-structure with telescopic pieces (14, 15) and bars (11, 12, 13) fixed thereto, at various angles to the horizontal, to which may be fixed stepped elements for the attachment of superstructure pieces such a seats and railings. Said bars (11, 12, 13), may be pivoted about a pivot point (23, 24, 25), in the region of a first end (16, 17, 18) of a bar (11, 12, 13), in a manner independent of the angle to the horizontal. Each individual bar (11, 12, 13) comprises a first attachment point for stepped elements and the pivot point (23, 24, 25) of a bar (11, 12, 13) is either congruent with the first attachment point (26) or it is immediately adjacent to the pivot point (23, 24, 25).

12 Claims, 10 Drawing Sheets

STAGE CONSTRUCTION

The invention concerns a transportable stand with elements which can be assembled from individual parts and be dismounted, which comprise a supporting structure and telescopic parts and cheeks which can be mounted thereon at different angles of inclination to the horizontal, which hold step elements for installation of mounting parts such as seats and rails.

BACKGROUND OF THE INVENTION

A stand construction of this type has been disclosed by a stand of the company Arena Seating.

In the conventional stand construction, cheeks are mounted to a supporting structure, which are either prolonged or shortened, through telescopic elements, at both ends depending on the inclination of the cheeks to the horizontal. The known cheeks can be used at different inclinations by providing mounting means for step elements on one cheek side and also on the cheek side diametral thereto with different separations from the respective cheek end.

To be able to offer an extended number of seats and more standing space at venues or in halls, transportable stands are known which consist of a plurality of individual parts and require a lot of time for assembly and/or disassembly. The individual stand parts are often large and heavy such that the stands, which are usually to be mounted without the assistance of a crane, are difficult to handle.

It is the underlying purpose of the invention to design stands which can be used according to the local requirements with easy assembly and/or disassembly and to reduce the number of or simplify the different elements required for assembly and/or disassembly.

SUMMARY OF THE INVENTION

This object is achieved in accordance with the invention in that the cheeks can be pivoted independently of the angle of inclination to the horizontal about a point of rotation which lies in the region of a first cheek end, and that each individual cheek has a first receiving point for the step elements which either coincides with the point of rotation or is disposed directly next to the point of rotation.

The stand construction comprising the inventive cheeks is advantageous in that step elements to be mounted to the cheeks always have a fixed predetermined first receiving point independent of the angle position of the cheeks to the horizontal where the first or last step element is mounted. Mounting of the inventive stand precludes or greatly reduces erroneous assembly of individual parts required for assembly since the screen for the step elements to be disposed on the cheeks always starts or terminates at the same first receiving point. An inventive cheek must be prolonged or shortened at only one end since the step elements used always terminate in the fixed first receiving point. The first receiving point for the step elements is also always the same, independent of the respective inclined position of a cheek. The first receiving point is not displaced in height and does not carry out a lateral motion when the angle positions of the cheeks vary. The bringing together of the point of rotation of a cheek in a different angle position and the first receiving point of a cheek for a step element further simplifies the overall construction. In total, the inventive construction reduces the number of elements required for assembling a stand and also reduces the number of different concrete designs of the elements.

In a further embodiment of the invention, the point of rotation has the same separation from the first end of the respective cheek irrespective of the length of a cheek. This is advantageous in that all inventive cheeks used in the stand construction are moved, i.e. pivoted, in the same fashion to obtain the predetermined end position of a cheek desired in the assembled state. If the points of rotation are equally fixed to each cheek, the overall stand structure is simplified.

In a further embodiment of the invention, the cheeks, telescopic parts, step parts and mounting parts can be joined to one another or joined to the supporting structure via secured plug and/or catch connections.

This is advantageous in that no loose individual parts are used for assembly of the stand and additional time-consuming screwing or wedging can be omitted. All connecting parts such as cheeks, step elements, telescopic parts, receiving heads, securing means, seat and/or rail connections can be coated with elastic surfaces and/or with elastic formations, profiles to connect the overall construction or individual connections of this construction in a sound-proof, in particular impact-sound-proof, sealed or play-free fashion. This measure eliminates noise which could be produced by individual elements under load.

In a further embodiment of the invention, the plug and/or catch connections are formed such that they are self-locking when connected which guarantees permanent secure assembly of the stand since security and safety checks are not required for a stand built with the inventive elements.

In a further embodiment, receiving heads are formed on the supporting structure of the inventive stand design, which receive the first end of a cheek and/or an end of the telescopic part.

This is advantageous in that no particular connecting elements are required between supporting structure and the cheeks to be mounted thereto. The receiving heads can securely and permanently hold the cheeks at the most different inclinations without additional screwing or bolting or wedging.

The receiving heads are formed to receive cheeks and telescopic parts which can be oriented at least at two different angles of inclination to the horizontal such that the same receiving heads can be used for any stand construction.

In a preferred embodiment of the invention, the receiving heads, holding a first end of a cheek, hold bolts which laterally project from the cheeks, wherein in the assembled state of the parts at least one bolt is overlapped by the respective receiving head and the bolts additionally project into a cavity which is limited by cheeks produced from a hollow section. One end of a telescopic part projects into this cavity and at least partially surrounds the bolts or rests on the bolts. The telescopic head of the telescopic part may be supported on the inner surface of a cheek for load relief and further means can be provided to connect and secure the connection to be created for forces acting in the horizontal direction.

This measure produces simple, permanent and safe connecting possibilities. The connections can be quickly formed and released with simple movements.

In a further development of the invention, recesses or mounting points are provided on an outer side of the cheek at defined separations into which profiled ends of the step elements engage or the profiled ends are mounted at the mounting points.

This is advantageous in that the step elements can be securely held on the cheeks via the most simple mounting means. Such cheeks can be produced at low cost and are easy to handle.

If the recesses are formed as openings of approximately twice the length of a width of a profiled end, laterally adjoining step elements can be introduced at one cheek. Only one opening is required at one cheek for both step elements. In a preferred embodiment, at least one of the profiled ends of a directly adjoining skeleton step or riser projects into the hollow section of the individual cheek and is immovably held on the cheek in a self-locking fashion or via fixing elements. This is advantageous in that the compelling sequence of the elements to be mounted, prevents having to work over gaps when the skeleton steps and risers are disposed on the cheeks.

The overall stand system is further facilitated if the step elements are formed from risers and skeleton steps, wherein the skeleton steps have the same step depth irrespective of the inclination of a cheek to the horizontal, and if openings are provided at the step edge bordering the risers for receiving the mounting elements. The same skeleton steps are used for any angle position of a cheek, and the step elements have openings for receiving seats or rail constructions. The seats or rails must be inserted into the openings provided for this purpose and are held in the openings in a self-locking fashion. The risers can also be simplified if they can be folded at some height and thus be adjusted to the most different angle positions of the cheeks in a simple way. The foldable section to extend a riser can be hinged to the skeleton step and/or the riser itself. For different angle positions of the cheeks, risers of different heights are provided. If e.g. cheeks of a length of 2.50 m are used for mounting a stand on a supporting structure with 50 cm height grid, and the step elements are mounted to the cheeks in accordance with the invention, skeleton steps of a step depth of 75 cm can be used for different angle positions of 0°, approximately 11° and approximately 22° and the risers have a height of 15 cm for an angle position of the cheeks of approximately 11° and, for an angle position of the cheeks of approximately 22°, a height of 30 cm.

If the smallest common multiple of step depth and a grid width of the supporting structure is larger than a grid width but smaller than approximately five times the grid width, all desired angles of inclination of a stand can be produced with one single embodiment of a cheek. In a preferred embodiment, with a uniform cheek length of 2.50 m, platforms are possible after every three grid widths. If cheeks of different lengths are combined, horizontally oriented platforms can be produced in shorter recurrent separations. To provide safe escape paths with the inventive stand construction, horizontally oriented cheek lengths of 75 cm are sufficient when they are connected to inclined cheeks of a length of 2.50 m. If the angle position of an inclined cheek is approximately 11°, the cheek must be prolonged to approximately 2.55 m through the telescopic part. If the angle position of a cheek is approximately 22°, the cheek is to be extended to approximately 2.69 m through a telescopic part. The predetermined lengths refer to a horizontally oriented cheek (0°) of 2.50 m and a height grid of 50 cm or 100 cm at the supporting structure.

Further advantages can be extracted from the description and the enclosed drawing. The features mentioned above and below can be used in accordance with the invention either individually or collectively in any arbitrary combination. The embodiments mentioned are not to be understood as exhaustive enumeration but rather have exemplary character for describing the invention. The step elements can be mounted on any type of cheeks. The described step elements must not necessarily be used with the described cheeks.

If rail posts are mounted to the step elements, these rail posts can be inserted into cavities of the skeleton steps and/or risers and further fixing and/or securing of the rail posts can be effected through engagement into the openings in the cheeks. The skeleton steps and risers can also be of one piece such that a step element is formed from one single element.

BRIEF DESCRIPTION OF THE DRAWINGS

The invention is shown in one embodiment in the drawing.

DETAILED DESCRIPTION

Figure 1:
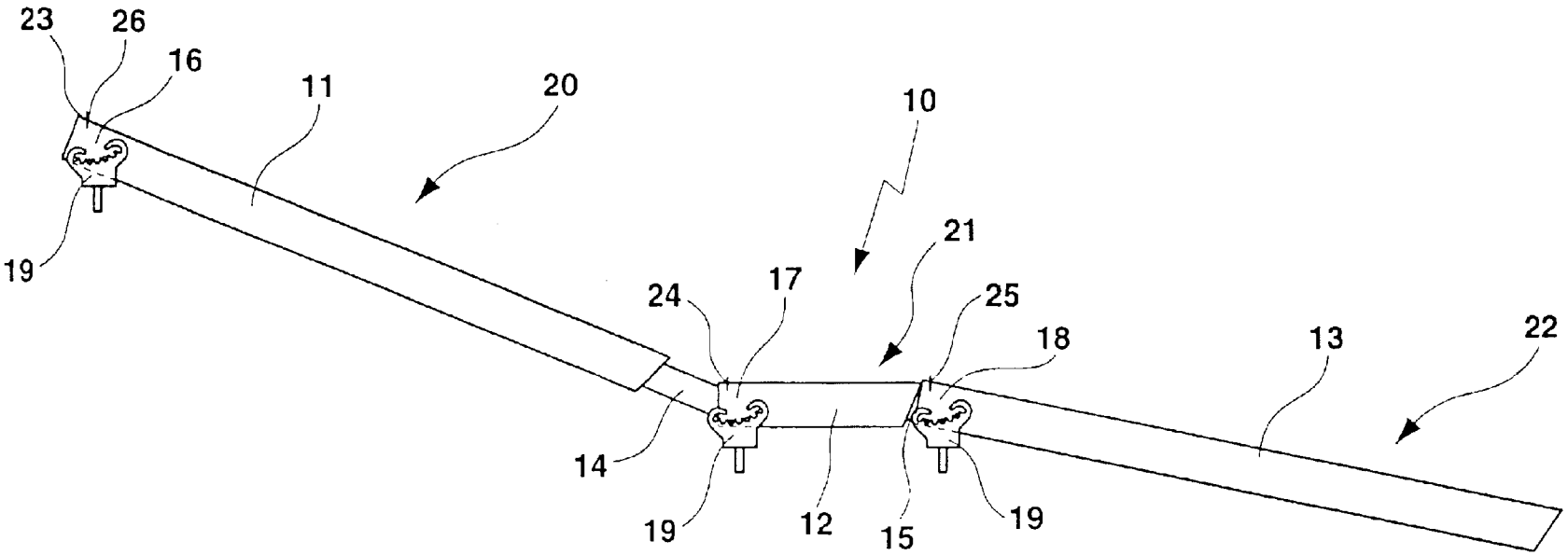
FIG. 1 shows an inventive cheek connection with receiving heads.

In FIG. 1, reference numeral 10 illustrates elements of a stand which can be mounted and dismounted, comprising a first cheek 11, a second cheek 12 and a third cheek 13. The cheeks 11, 12, 13 are interconnected via a first telescopic part 14 and a second telescopic part 15. The first cheek 11, the second cheek 12 and the third cheek 13 are held at a first end 16, 17, 18 of the cheeks 11, 12, 13 via receiving heads 19 which are supported by a supporting structure, e.g. a scaffold structure. The supporting structure is a construction known from the state of the art which is therefore not shown in FIG. 1.

In FIG. 1, the first cheek 11 is inclined to a first angle position 20 i.e. at an angle of inclination to the horizontal of e.g. approximately 22°. The second cheek 12 is shown in a second angle position 21, e.g. 0° and the third cheek 13 is shown in a third angle position 22, inclined to the horizontal by approximately 11°.

The cheeks 11, 12, 13 serve for mounting step elements which generally consist of skeleton steps and risers. Mounting parts such a seats and rails can be mounted to the step elements which are not shown in the figure.

The cheeks 11, 12, 13 of the inventive stand construction can be pivoted about points of rotation 23, 24, 25 which are in the region of the first ends 16, 17, 18. In the region of the first ends 16, 17, 18, holding means are provided on the cheeks 11, 12, 13 which are received by the receiving heads 19. The cheeks 11, 12, 13 are formed of a hollow section.

The ends of the cheeks 11, 12, 13, opposite to the first ends 16, 17, 18, are provided with telescopic parts 14, 15 for connection to a further cheek and for interconnecting the adjoining cheeks 11, 12, 13. The telescopic parts 14, 15 can be drawn out of the respective cheek ends to different lengths and be fixed in any position to keep a grid width predetermined by the supporting structure or the horizontally oriented cheek length in dependence on a predetermined angle of inclination to the horizontal. If step elements are disposed on the cheeks 11, 12, 13, these step elements are disposed irrespective of the angle of inclination to the horizontal of a cheek 11, 12, 13 always such that the first or last step element is mounted in a first receiving point 26 (depending on the direction of assembly) which coincides with the point of rotation 23 or is formed directly next to the point of rotation 23.

FIG. 1 shows two cheek lengths. The length of the first cheek 11 corresponds to the length of the third cheek 13, the second cheek 12 for the second angle position 21 of 0° is shorter than the first cheek 11 and the third cheek 13. The angle position 20 is approximately 22° and the angle position 22 is approximately 11°.

Figure 2:
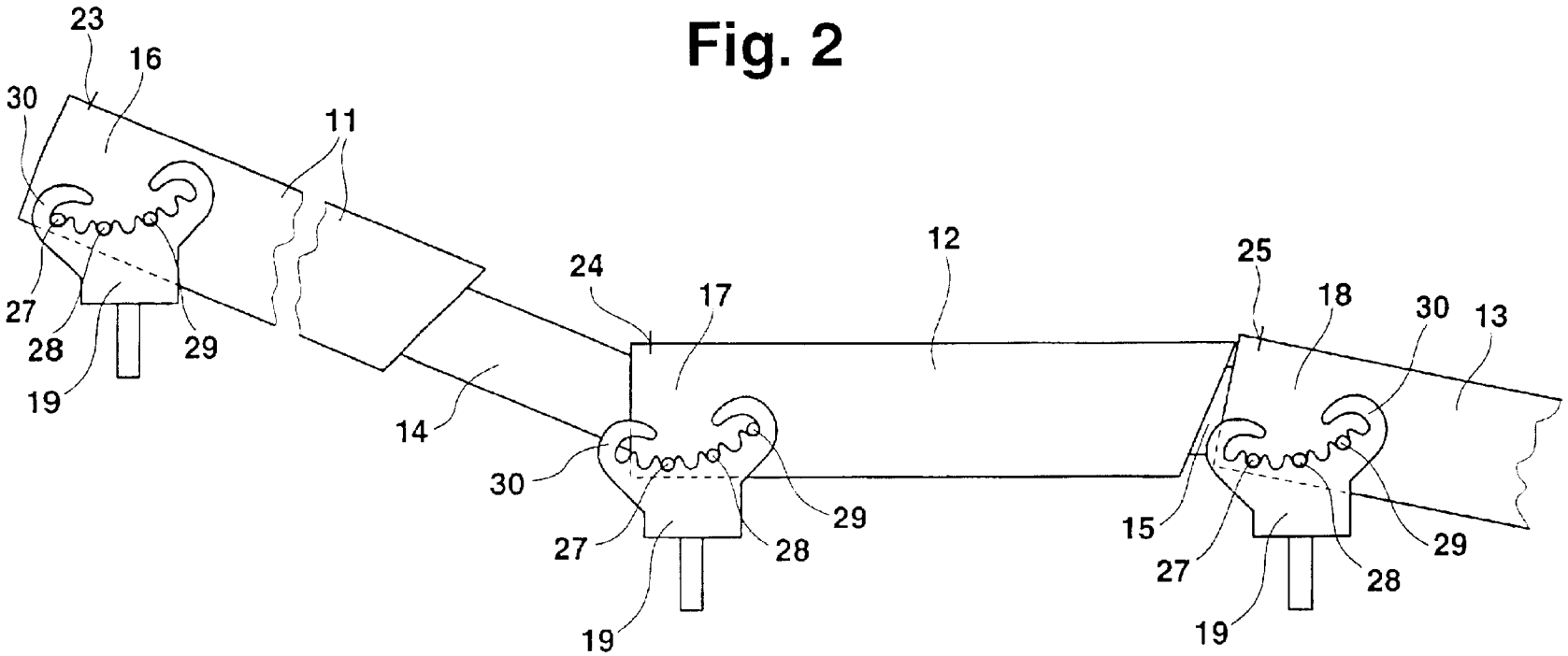
FIG. 2 shows the inventive cheek connection of FIG. 1 on an enlarged scale.

FIG. 2 shows, compared to FIG. 1, an enlarged view of the cheeks 11, 12, 13. The cheeks 11, 13 are displayed shortened for a better overview. The cheeks 11, 12, 13 are interconnected via the first telescopic part 14 and the second telescopic part 15. The receiving heads 19 hold the cheeks 11, 12, 13 at the first end 16, 17, 18 in that bolts 27, 28, 29 formed on the cheeks 11, 12, 13 engage in recesses of the receiving heads 19. The bolts 27, 28, 29 are disposed on a circular arc whose center is in the point of rotation 23, 24, 25. The radius from the point of rotation 23, 24, 25 to the circular arc with the bolts 27, 28, 29 is always the same in the inventive cheeks 11, 12, 13. The position of the bolts 27, 28, 29 on the circular arc may differ depending on the desired inclination of the cheeks 11, 12, 13 within an overall stand construction. The recesses, formed on the receiving heads 19, for the bolts 27, 28, 29 are selected such that they can receive the bolts 27, 28, 29 in different angle positions of the cheeks 11, 12, 13 and are designed such that at least one bolt 27, 28, 29 is overlapped by a hook-shaped end 30 of a receiving head 19. The hook-shaped ends 30 of the receiving heads 19 secure the connection between the receiving head 19 and a cheek 11, 12, 13 from inadvertent release of the connection between receiving head 19 and the cheek 11, 12, 13.

Figure 3:
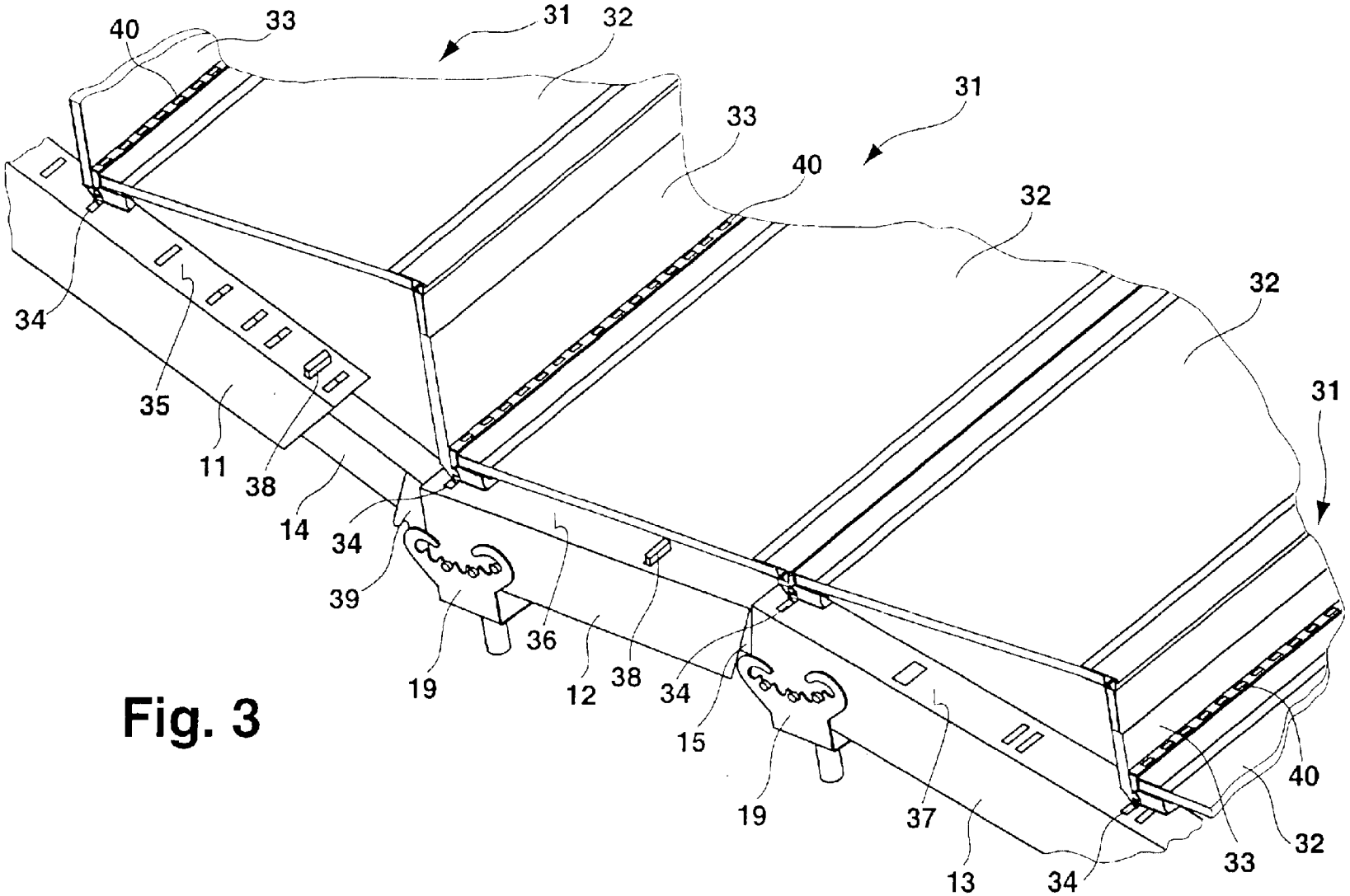
FIG. 3 shows a perspective view of inventive cheek elements with inventive step elements shown in sections.

FIG. 3 shows a partial spatial section of an inventive stand construction with step elements 31 which are composed of skeleton steps 32 and risers 33. The step elements 31 can be detachably mounted to the cheeks 11, 12, 13 in that profiled ends of the step elements 31 engage in openings 34 of the cheeks 11, 12, 13 which are formed on a cheek side 35, 36, 37. The openings 34 formed on the cheek side 35, 36, 37 are separated from each other such that skeleton steps 32 with the same step depth can be mounted in or on the openings 34 independent of the angle position of the individual cheeks 11, 12, 13, and a first step element is always mounted in the first receiving point. The telescopic parts 14, 15 comprise a mandrel 38 which can also engage in the openings 34 and which can determine the length of the telescopic part 14, 15 to be selected. A telescopic head 39 of the first telescopic part 14 is partially visible in FIG. 3. The telescopic head 39 connects the first cheek 11 to the second cheek 12. The supporting structure which is not shown in FIG. 3 holds the cheeks 11, 12, and 13 via the receiving heads 19.

In the transition region between a skeleton step 32 and a riser 33, a series of openings 40 are provided which can receive mounting elements such as seats and rails.

Figure 4:
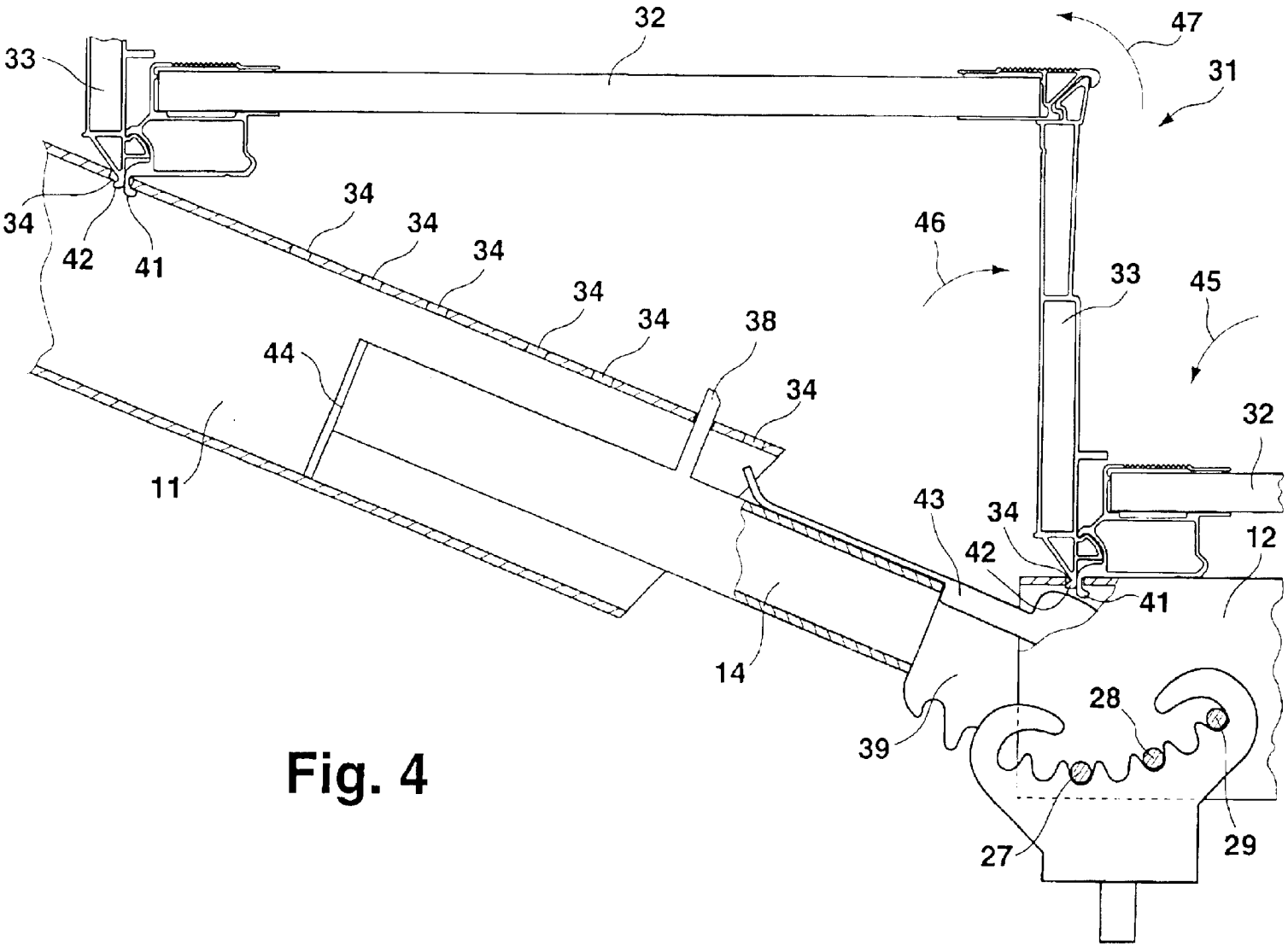
FIG. 4 shows a connection between an inventive cheek and an inventive telescopic part with the possibility to mount and dismount an inventive step element.

FIG. 4 shows the transition region between a first cheek 11 and a second cheek 12, partially in sectional view such that the profiled ends 41, 42 of the skeleton steps and risers 32, 33 are visible and also the securing lock 43 of the first telescopic part 14. The profiled end 41 of the skeleton step 32 engages through one of the openings 34 and engages behind the first cheek 11 with the free end. The profiled end 42 of the riser 33 also engages in the opening 34 and is designed such that in cooperation with the profiled end 41, it blocks or prevents vertical displacement of skeleton step and riser 32, 33. The numerous openings 34 formed in the first cheek 11 are provided for the step elements 31 when the cheeks 11, 12 are mounted in different angle positions. With the mandrel 38, the first telescopic part 14 engages through an opening 34 and is supported at one end via the telescopic head 39 on the second cheek 12. The telescopic head 39 comprises additionally the securing lock 43 which secures connection between the first telescopic part 14 and the second cheek 12. The first telescopic part 14 is supported on the other end via a supporting plate 44 on the inner surface of the first cheek 11.

The bolts 27, 28, 29 serve as holding means for the receiving head 19 as well as for the telescopic head 39. The bolts 27, 28, 29 project past the cheek outside and into the hollow section of the cheek 12 such that the telescopic head 39 can at least partially surround the bolts 27, 28, 29. FIG. 4 shows the securing lock 43 in a position in which the first telescopic part 14 is undetachably connected to the second cheek 12.

If a supporting structure with mounted cheeks 11, 12 is erected and the cheeks 11, 12 have mounting points like the openings 34 shown in FIG. 4, the skeleton steps and risers 32, 33 can be mounted to the cheeks 11, 12 such that no auxiliary construction or additional means is required. The skeleton step 32 is disposed on the second cheek 12 in the direction of the arrow 45 by pivoting the skeleton step 32 such that the profiled end 41 engages in the opening 34 and engages behind this opening 34. If the skeleton step 32 is positioned, the riser 33 can be inserted into the opening 34 by pivoting it in the direction of the arrow 46. If the riser 33 is vertically oriented and the profiled ends 41, 42 engage in the opening 34 as shown in the figure and the skeleton step 32 is hooked with the riser 33 through the mutual engagement, the skeleton step 32 and the riser 33 are rigidly and undetachably connected to the second cheek 12. If the riser 33 shall be released from the second cheek 12, the riser 33 must be pivoted against the direction of arrow 46 that far that the profiled end 42 can be removed from the opening 34. If the riser 33 has been removed from the opening 34, the skeleton step 32 can be released through motion of the skeleton step 32 against the direction of arrow 45 from the second cheek 12.

If a further skeleton step 32 shall be disposed on a vertically oriented riser 33, this skeleton step 32 is to be disposed on the riser 33 through a pivoting motion in the direction of arrow 47. When the skeleton step is disposed on the riser 33, nubs and noses engage behind the end of the riser 33 such that the skeleton step 32 is undetachably connected to the riser 33. The skeleton step 32 can be released from the riser 33 only via a motion against the direction of arrow 47. The mounting and dismounting of the skeleton step and risers 32 and 33 described for a step element 31 can be transferred arbitrarily to a step element adjoining a step element 31 such that the described assembly and disassembly of skeleton step and risers 32, 33 can produce stand constructions of any height and length.

Figure 5:
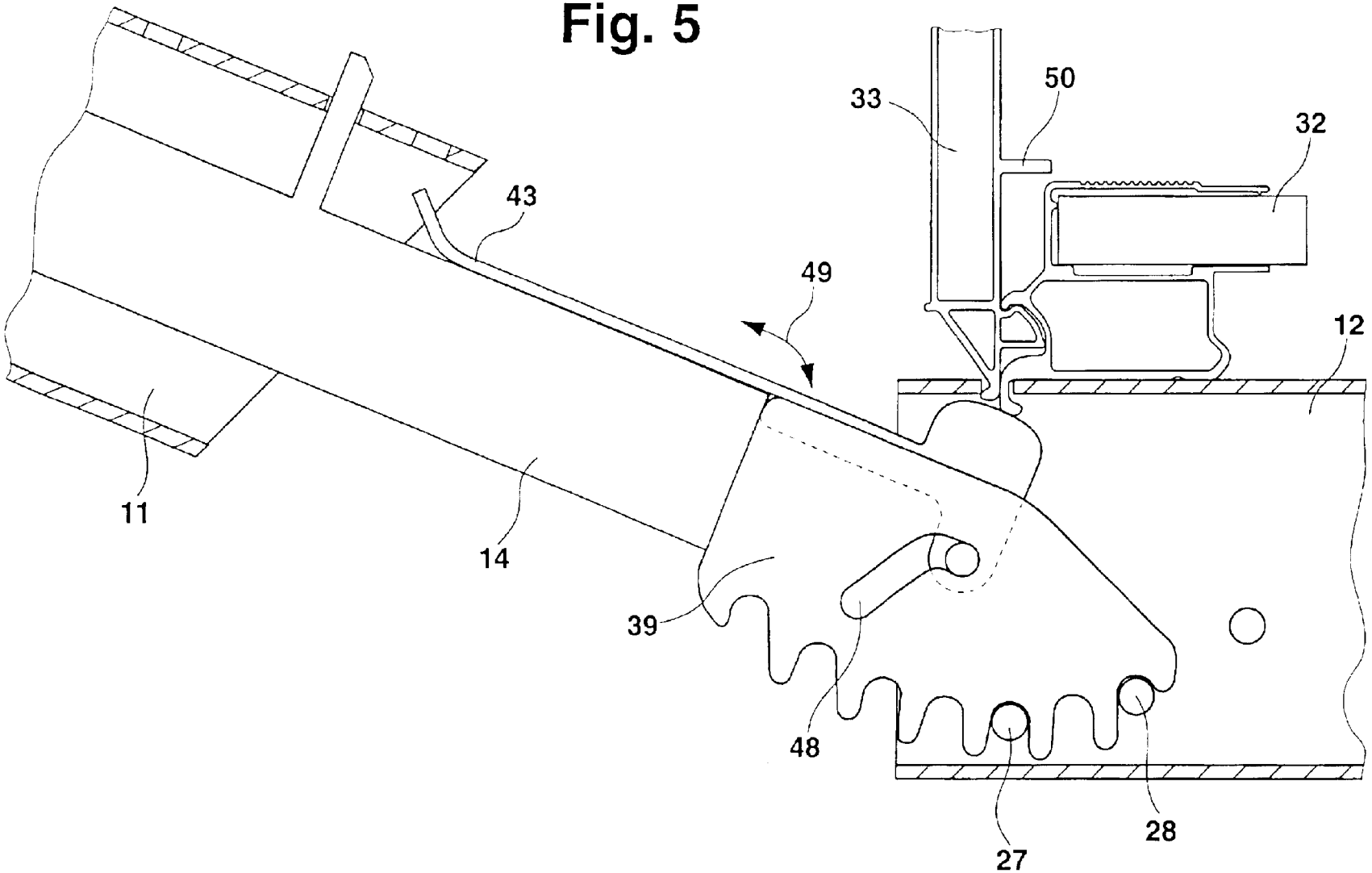
FIG. 5 shows the connection of a telescopic part to a first cheek end.

FIG. 5 shows a cross-sectional view of the first cheek 11 and second cheek 12 to show the connection of the telescopic head 39 to the second cheek 12. The securing lock 43 is kept in the telescopic head 39 such that it can be lifted and displaced in the direction of arrow 49. In the position shown in the figure, the telescopic head 39 overlaps the bolts 27 and 28 with recesses formed on the telescopic head 39 and the securing lock 43 is shown in an end position in which the first telescopic part 14 is undetachably connected to the second cheek 12. If the securing lock 43 is displaced into the other end position in the elongate hole 48, the connection between the second cheek 12 and the first telescopic part 14 can be released. The skeleton step 32 and the riser 33 are inserted in the second cheek 12 in a self-locking fashion and a projection 50 is formed on the riser 33 which can house the openings 40 shown in FIG. 3.

If the skeleton step 32 is connected to the riser 33, a ball formed on the riser 33 is disposed in a socket of a ball and socket joint, which is formed in the edge region of the skeleton step 32. Both the ball-shaped and the socket-shaped formation can extend across the entire length of a skeleton step and/or riser 32, 33. A projection formed on the socket engages behind or into a recess on the ball of the riser 33 to produce an undetachable connection between skeleton step and riser 32, 33. If the connection between the skeleton step and riser 32, 33 in the lower region, i.e. in the region of the cheek shall be released, the ball must at first be turned out or displaced out of the overlapping or locking engagement in the socket until both parts can be separated.

Figure 6:
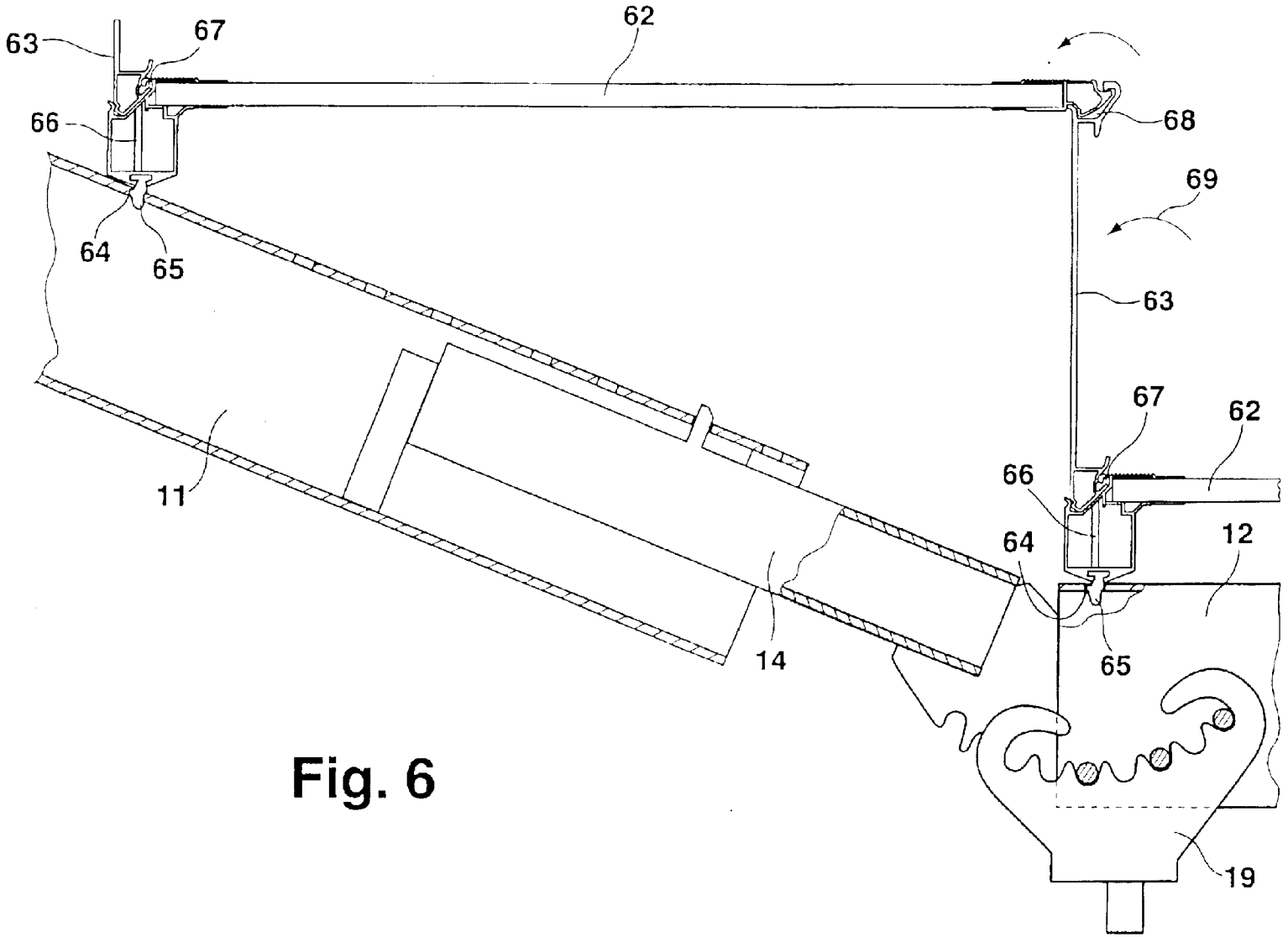
FIG. 6 shows a side view of a further inventive embodiment of a cheek connection with two skeleton steps and one riser.

FIG. 6 shows a further embodiment of inventive elements of a stand which can be mounted and dismounted. The first cheek 11 is connected to a second cheek 12 via the telescopic part 14. A skeleton step 62 which is detachably connected to a riser 63 is disposed on the cheek 12 which is held in its horizontally oriented position by a receiving head 19. A further skeleton step 62 is held at the upper end of the riser 63, and the other end of the further skeleton step 62 flatly rests on the inclined cheek 11. Another riser 63 joins this end which has the same connection to the skeleton step 62 as shown in the right part of FIG. 6.

The cheek 12 has an opening 64 via which a pin 65 of an end profile of the skeleton step 62 engages. The end profile of the skeleton step 62 has a catch 66 which engages behind an edge projection of the cheek 12 and undetachably connects the skeleton step 62 to the cheek 12. A receiving pocket 67 is formed on the end profile of the skeleton step 62 opposite to the pin 65 into which the lower end profile of the riser 63 engages in a detachable fashion. The upper end of the riser 63 is provided with a further end profile with a recess 68 which holds a free end of the skeleton step 62 which is not supported on a cheek 11, 12.

If a step element is to be disposed on an inventive cheek connection, at first the skeleton step 62 is disposed on the horizontally oriented cheek 12 in that the pin 65 is inserted into the opening 64. With this inserting motion, one end of the catch 66 engages automatically in a free edge of the cheek 12. If a riser 63 is to be inserted into the receiving pocket 67 of the skeleton step 62, the riser 63 is disposed at an angle on the end of the skeleton step 62 in that the erected skeleton step 62 subtends an angle <90° with the riser 63. Subsequently, the riser 63 is pushed past the skeleton step 62 that far that the riser 63 falls into the receiving pocket 67. In the still present inclined position of the riser 63, the riser 63 is lifted and simultaneously vertically oriented in the direction of arrow 69 in an anticlockwise direction. Subsequently, the riser 63 is lowered and is held in the receiving pocket 67 in a position shown in FIG. 6. If a further skeleton step 62 is to be connected to the riser 63 at the upper end of the riser 63, a skeleton step 62 is vertically oriented and inserted into the recess 68 and subsequently lowered in an anticlockwise direction in the direction of arrow 70 that far until the other free end of the skeleton step 62 with the pin 65 engages into the opening 64 of the inclined cheek 11. The end profile of the skeleton step 62 is formed such that it can flatly abut on an inclined cheek 11.

If a riser 63 is inserted into the receiving pocket 67 and vertically aligned it blocks the pivoting region of the catch 66 and holds the catch 66 such that a free end of the catch 66 always engages behind a free edge section of the cheek 11, 12. In the arrangement shown in FIG. 6, the skeleton steps 62 cannot be lifted from the cheeks 11, 12.

If a step element is to be lifted from a cheek connection shown in FIG. 6, the riser 63 must firstly be lifted in the receiving pocket 67 until it can be turned out of the receiving pocket 67 in a clockwise direction. If the connection between the skeleton step 62 and the riser 63 is interrupted in that the receiving pocket 67 is free, the catch 66 is also pivotable and the skeleton step 62 can be lifted from the cheek 11, 12. When lifting the skeleton step 62, the catch 66 automatically opens i.e. it releases the engagement on the cheek 11,12.

Figure 7:
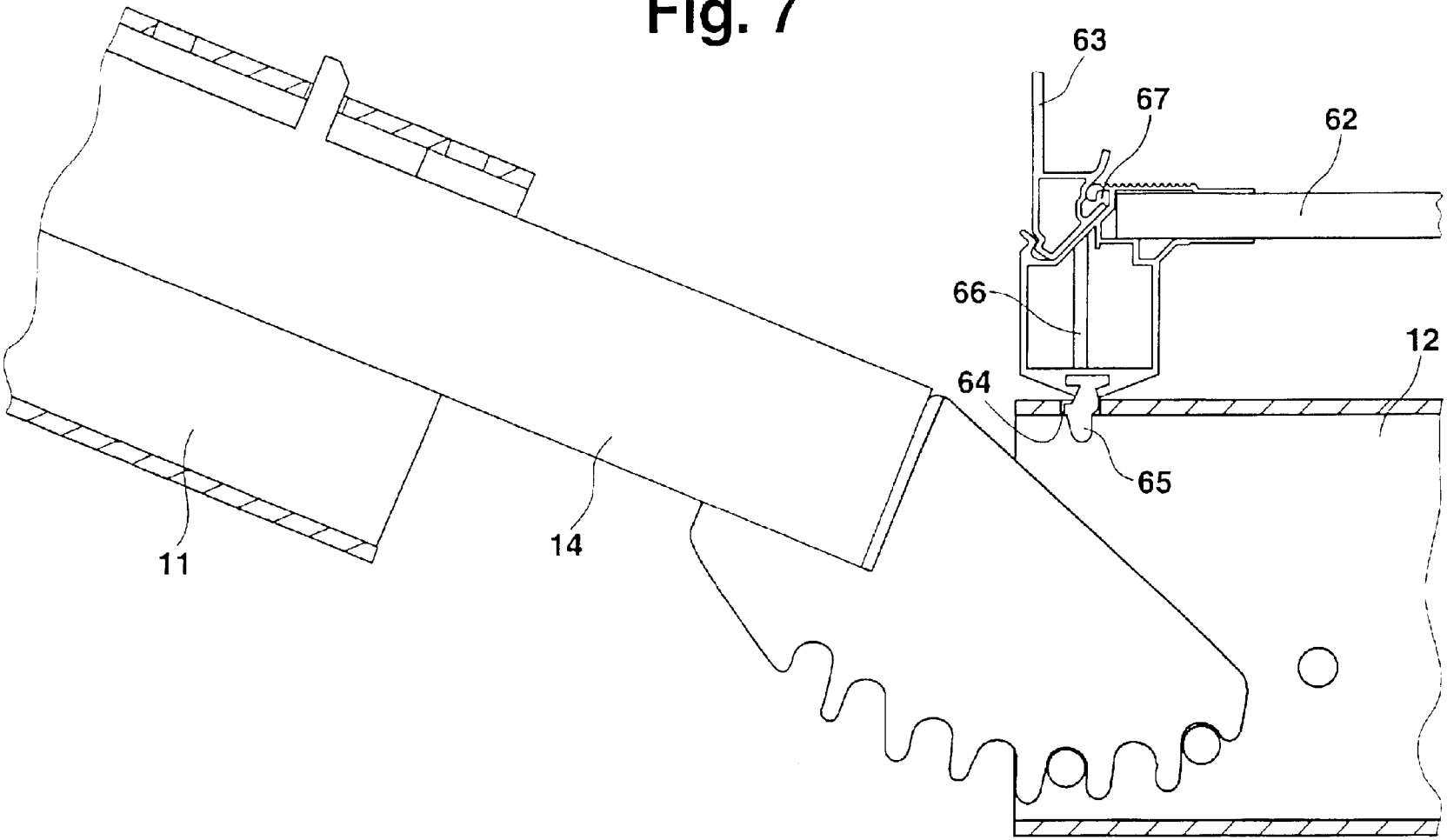
FIG. 7 shows a side view of FIG. 6 on an enlarged scale showing the connection of a telescopic part to a cheek.

FIG. 7 shows the cheek connection of the cheeks 11 and 12 with a cut cheek 12, how the two cheeks 11 and 12 are interconnected via the telescopic part 14. The skeleton step 62 is disposed on the cheek 12 in that the pin 65 engages in the opening 64 of the cheek 12. The end profile of the skeleton step 62 is undetachably held together with the cheek 12 via the catch 66. An end of the riser 63 is inserted into the receiving pocket 67 of the end profile of the skeleton step 62. The riser 63 is vertically oriented and the receiving pocket 67 is formed such that it comprises a free space when a riser 63 is inserted into the receiving pocket 67. The free space permits that the vertically aligned riser 63 can be lifted in the receiving pocket 67. If the riser 63 is lifted, it engages behind a hook-shaped formation on the end profile of the skeleton step 62, and in the lifted state of the riser 63 it is possible to pivot the riser 63 in a clockwise direction such that it can be removed from the receiving pocket 67. When the riser 63 is vertically oriented and inserted in the receiving pocket 67, the catch 66 cannot be moved and connects the skeleton step 62 with the cheek 12 or cheek 11 in an undetachable fashion.

Figure 8:
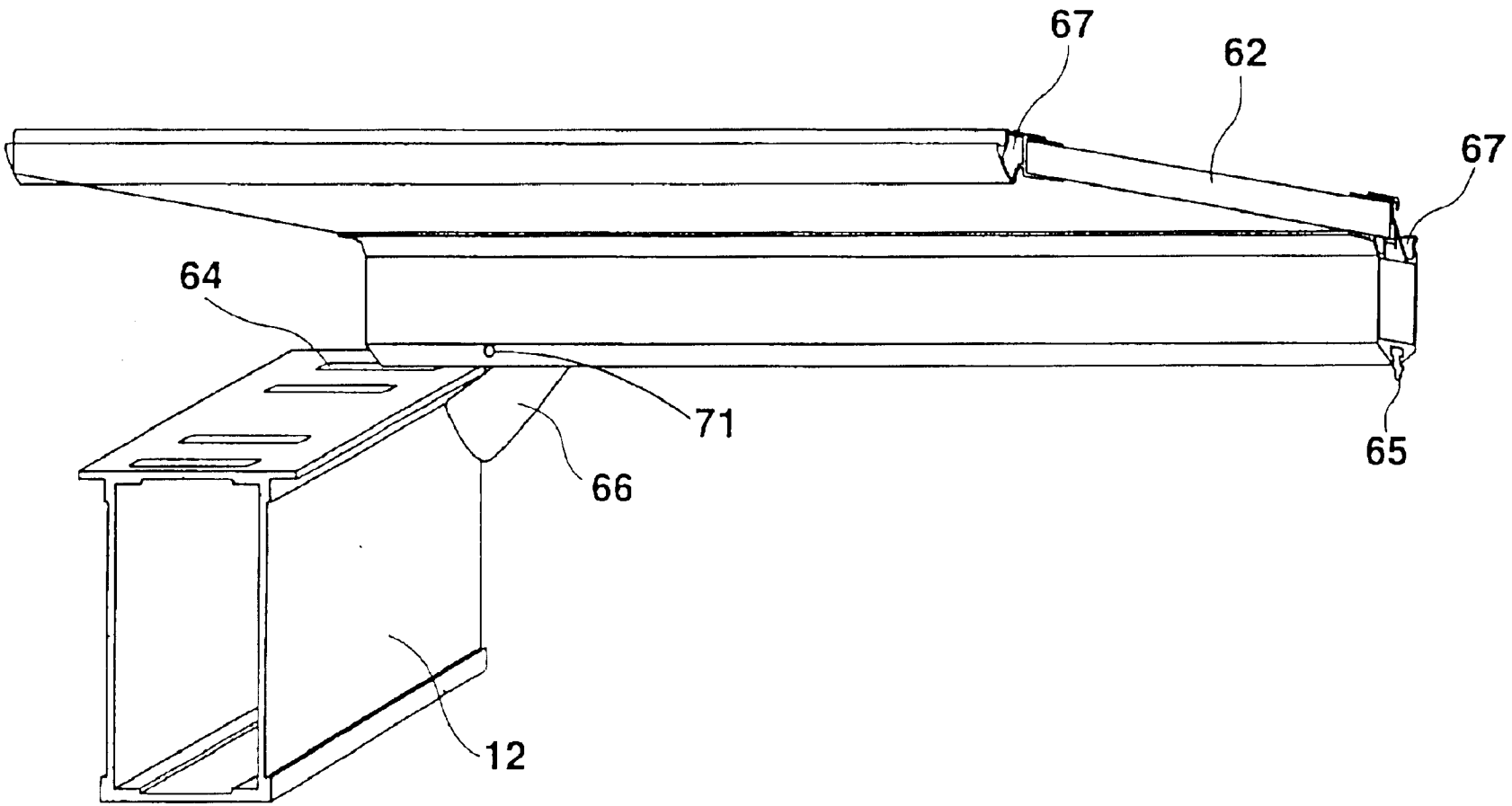
FIG. 8 shows a perspective view of a skeleton step in accordance with FIGS. 6 and 7 adjoining a horizontally oriented cheek.

FIG. 8 shows a perspective view of a shortened and horizontally oriented cheek 12 onto which a skeleton step 62 is disposed. FIG. 8 does not show the entire width of the skeleton step 62. A skeleton step 62 basically has in each free end region two opposing support points with pins 65 which engage in openings 64 of a cheek 12 in each case. FIG. 8 shows only one cheek 12. The skeleton step 62 engages via the pin 65 into the opening 64, and when the skeleton step 62 is disposed on the cheek 12, an end of the catch 66 engages behind a free edge section of the cheek 12. The catch 66 is fastened on the skeleton step 62 such that it can be pivoted about an axis 71. The receiving pockets 67 are indicated in the figure into which ends of risers 63 can engage. If the skeleton step 62 is lifted from the cheek 12, the catch 66 automatically pivots in that it releases the engagement on the cheek 12. The skeleton step 62 can always be lifted from the cheek 12 when the receiving pocket 67 is not occupied by a riser 63.

Figure 9:
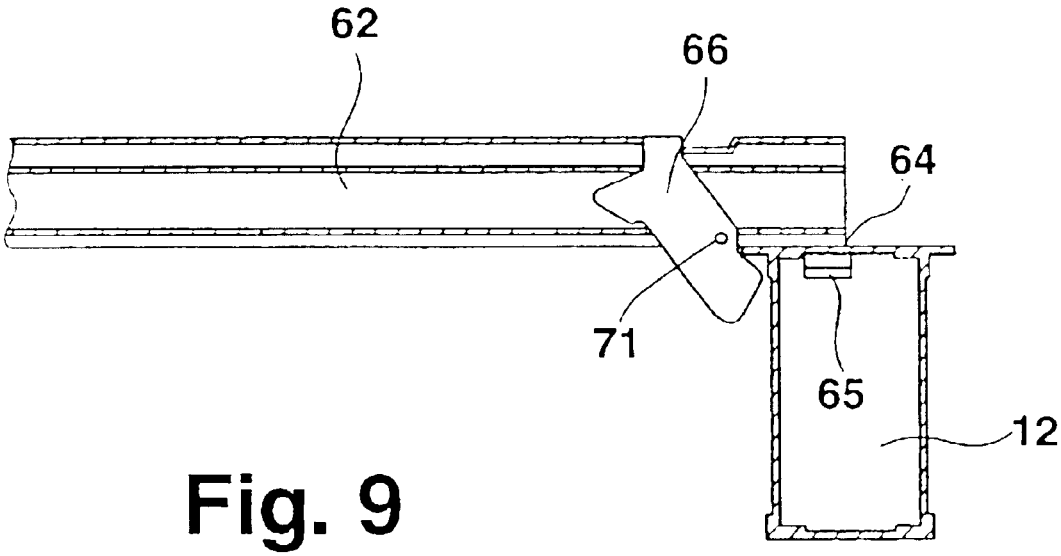
FIG. 9 shows a sectional representation of a skeleton step which is seated and secured on a horizontally oriented cheek.

FIG. 9 shows a sectional representation of a skeleton step 62 disposed on a cheek 12. The pin 65 of the skeleton step 62 engages in the opening 64 of the cheek 12 and the catch 66 engages behind a free edge section of the cheek 12 by correspondingly turning about the axis 71.

Figure 10:
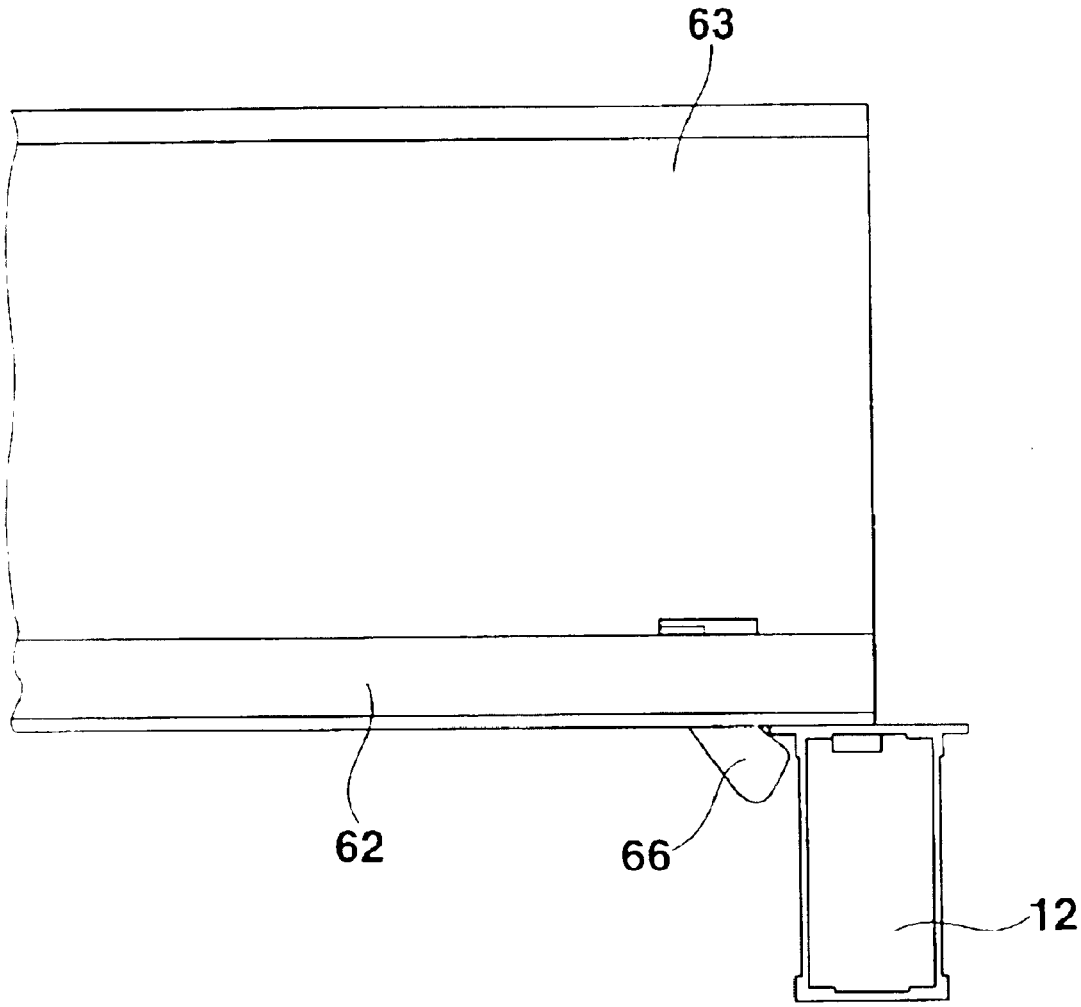
FIG. 10 shows a rear view of a riser and skeleton step which seats on a horizontally oriented cheek.

FIG. 10 shows a rear view of a skeleton step 62 and a riser 63 disposed on the one cheek 12 on a side. The catch 66 engages behind a free edge section of the cheek 12, and in the arrangement shown, the skeleton step 62 cannot be lifted from the cheek 12.

In a stand with elements which can be mounted and dismounted from individual parts, and which comprise a supporting structure and telescopic parts 14, 15 which can be mounted thereon at different inclinations to the horizontal, and cheeks 11, 12, 13 which hold step elements for mounting mounting parts such as seats and rails, the cheeks 11, 12, 13 can be pivoted independently of the inclination to the horizontal about a point of rotation 23, 24, 25 which is located in the region of a first end 16, 17, 18 of a cheek 11, 12, 13. Each individual cheek 11, 12, 13 has a first receiving point for step elements and the point of rotation 23, 24, 25 of a cheek 11, 12, 13 either coincides with the first receiving point 26 for the step elements or it is directly neighboring to the point of rotation 23, 24, 25.

What is claimed is:

1. A transportable stand for assembly and disassembly on a supporting structure, such as a scaffold or the like, the stand comprising:

a plurality of cheeks;

a plurality of step elements supported by the cheeks, the step elements including steps and risers for mounting of seats and rails;

a plurality of telescopic parts, each telescopic part being received in a corresponding cheek and extendable therefrom;

a plurality of receiving heads for pivotably connecting adjacent cheeks and telescopic parts and enabling the cheeks to be pivoted irrespective of an inclination to a horizontal about points of rotation disposed at ends of each cheek, each cheek having a plurality of openings for receiving one of the step element.

2. The stand according to claim 1 wherein the points of rotation are equally spaced apart from first ends of respective cheeks independent of cheek length.

3. The stand according to claim 2 further comprising plug and catch connectors for joining the cheeks, telescopic parts, and step elements with one another, said plug and catch connectors being integral with the cheeks, telescopic parts and step elements.

4. The stand according to claim 3 wherein said plug and catch connectors are self-locking.

5. The stand according to claim 4 wherein said plug and catch connectors are disposed in a spaced apart relationship on the cheeks and the plugs comprise profiled ends of the step elements.

6. The stand according to claim 5 wherein the catch connectors comprise recesses having approximately twice a length of a width of a profiled end.

7. The stand according to claim 2 wherein said receiving heads are formed on said supporting structure.

8. The stand according to claim 7 wherein said receiving heads connect cheeks and telescopic parts at, at least, two different inclination angles to the horizontal.

9. The stand according to claim 8 further comprising head bolts projecting laterally from the cheek ends for engaging the receiving heads.

10. The stand according to claim 1 wherein the steps have a same depth irrespective of the inclination of a cheek to the horizontal and openings are provided at an edge of each step bordering each riser for receiving mounting element of seats and rails.

11. The stand according to claim 10 wherein the risers have different heights.

12. The stand according to claim 10 wherein a smallest common multiple of a step depth and a grid width of the supporting structure is larger than the grid width but smaller than approximately five times the grid width.

* * * * *